US009997128B2

(12) United States Patent
Jeon et al.

(10) Patent No.: US 9,997,128 B2
(45) Date of Patent: Jun. 12, 2018

(54) DISPLAY PANEL DRIVING APPARATUS, A METHOD OF DRIVING A DISPLAY PANEL USING THE DISPLAY PANEL DRIVING APPARATUS AND A DISPLAY APPARATUS INCLUDING THE DISPLAY PANEL DRIVING APPARATUS

(71) Applicant: SAMSUNG DISPLAY CO., LTD., Yongin-si, Gyeonggi-Do (KR)

(72) Inventors: Byungkil Jeon, Hwaseong-si (KR); Yongbum Kim, Suwon-si (KR); Eunseon Kim, Seoul (KR); Yongho Sung, Seongnam-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days. days.

(21) Appl. No.: 15/361,653

(22) Filed: Nov. 28, 2016

(65) Prior Publication Data

US 2017/0186395 A1 Jun. 29, 2017

(30) Foreign Application Priority Data

Dec. 29, 2015 (KR) ..... 10-2015-0188690

(51) Int. Cl.
*G09G 3/36* (2006.01)

(52) U.S. Cl.
CPC ..... *G09G 3/3688* (2013.01); *G09G 3/3677* (2013.01); *G09G 2300/0809* (2013.01); *G09G 2310/0291* (2013.01)

(58) Field of Classification Search
CPC .. G09G 3/3685; G09G 3/3688; G09G 3/3677; G09G 2300/0809; G09G 2310/0291
See application file for complete search history.

(56) References Cited

U.S. PATENT DOCUMENTS

| | | | | |
|---|---|---|---|---|
| 7,079,097 | B2 * | 7/2006 | Lee | G09G 3/3614 345/691 |
| 7,605,867 | B1 * | 10/2009 | Woodall | H04N 9/896 348/512 |
| 8,018,420 | B2 * | 9/2011 | Lee | G09G 3/3648 345/100 |
| 2004/0183761 | A1 * | 9/2004 | Miyachi | G09G 3/3648 345/87 |
| 2005/0140619 | A1 * | 6/2005 | Hong | G09G 3/3611 345/87 |

FOREIGN PATENT DOCUMENTS

| | | |
|---|---|---|
| KR | 10-2015-0060360 | 6/2015 |
| KR | 10-2015-0081103 | 7/2015 |

* cited by examiner

*Primary Examiner* — Tom Sheng
(74) *Attorney, Agent, or Firm* — F. Chau & Associates, LLC

(57) ABSTRACT

A display panel driving apparatus includes a data processor configured to receive N-th line data of image data. N is a natural number not less than 2. The data processor is further configured to perform a first line delay on the N-th line data to output (N−1)-th line data, to output (N−1)-th line substitution data which is obtained by N-th line substitution data, which is based on the N-th line data and the (N−1)-th line data, and to compensate the N-th line data based on the N-th line data and the (N−1)-th line substitution data to output compensation image data. The display panel driving apparatus further includes a data driver and a gate driver.

20 Claims, 7 Drawing Sheets

DISPLAY PANEL DRIVING APPARATUS, A METHOD OF DRIVING A DISPLAY PANEL USING THE DISPLAY PANEL DRIVING APPARATUS AND A DISPLAY APPARATUS INCLUDING THE DISPLAY PANEL DRIVING APPARATUS

CROSS-REFERENCE TO RELATED APPLICATION

This application claims priority under 35 U.S.C. § 119 to Korean Patent Application No. 10-2015-0188690 filed on Dec. 29, 2015 in the Korean Intellectual Property Office, the disclosure of which is incorporated by reference herein in its entirety.

TECHNICAL FIELD

One or more exemplary embodiments of the present inventive concept relate to a display apparatus, and more particularly, to a display panel driving apparatus, a method of driving a display panel using the display panel driving apparatus, and a display apparatus including the display panel driving apparatus.

DISCUSSION OF THE RELATED ART

A display apparatus may include a display panel and a display panel driving apparatus. The display panel may include a gate line, a data line and a pixel. The display panel driving apparatus may include a gate driver and a data driver. The gate driver may output a gate signal to the gate line, and the data driver may output a data signal to the data line. As a distance from the data driver along the data line increases, a load on the data line may increase.

SUMMARY

According to an exemplary embodiment of the present inventive concept, a display panel driving apparatus includes a data processor configured to receive N-th line data of image data. N is a natural number not less than 2. The data processor is further configured to perform a first line delay on the N-th line data to output (N−1)-th line data, to output (N−1)-th line substitution data which is obtained by N-th line substitution data, which is based on the N-th line data and the (N−1)-th line data, and to compensate the N-th line data based on the N-th line data and the (N−1)-th line substitution data to output compensation image data. The display panel driving apparatus further includes a data driver configured to generate a data signal in response to the compensation image data output from the data processor, and to output the data signal to a data line of a display panel. The display panel driving apparatus additionally includes a gate driver configured to output a gate signal to a gate line of the display panel.

In an exemplary embodiment of the present inventive concept, the data processor includes a first line delaying circuit configured to receive the N-th line data, and to perform the first line delay on the N-th line data to output the (N−1)-th line data. The data processor further includes a substitution data generator configured to generate the N-th line substitution data based on the N-th line data and the (N−1)-th line data. The data processor additionally includes a second line delaying circuit configured to perform a second line delay on the N-th line substitution data and to output the (N−1)-th line substitution data.

In an exemplary embodiment of the present inventive concept, the substitution data generator includes a first look-up table for storing the N-th line substitution data according to the N-th line data and the (N−1)-th line data.

In an exemplary embodiment of the present inventive concept, the substitution data generator receives pixel position data indicating a pixel position in the display panel, and the N-th line substitution data is different according to the position of a pixel.

In an exemplary embodiment of the present inventive concept, the substitution data generator includes a plurality of first look-up tables for storing the N-th line substitution data.

In an exemplary embodiment of the present inventive concept, a load of the data line increases along a direction in which the data line extends away from the data driving part, and the pixel position data indicates the position of a pixel along the direction in which the data line extends.

In an exemplary embodiment of the present inventive concept, the data processor further includes a data compensating circuit configured to compensate the N-th line data based on the N-th line data and the (N−1)-th line substitution data and to output the compensation image data.

In an exemplary embodiment of the present inventive concept, the data compensating circuit includes a second look-up table for storing the compensation image data according to the N-th line data and the (N−1)-th line substitution data.

In an exemplary embodiment of the present inventive concept, the data compensating circuit receives pixel position data indicating a pixel position in the display panel, and the compensation image data is different according to the position of a pixel.

In an exemplary embodiment of the present inventive concept, the data compensating circuit includes a plurality of second look-up tables for storing the compensation image data.

In an exemplary embodiment of the present inventive concept, a load of the data line increases along a direction in which the data line extends away from the data driving part, and the pixel position data indicates the pixel position of a pixel along the direction in which the data line extends.

In an exemplary embodiment of the present inventive concept, the compensation image data increases according to an increase of the load of the data line.

In an exemplary embodiment of the present inventive concept, when (N−1)-th line pixel data, which is generated by charging the compensation image data to an (N−1)-th line pixel, does not reach a target level, the data processor outputs the (N−1)-th line substitution data.

In an exemplary embodiment of the present inventive concept, the (N−1)-th line substitution data is close to the target level.

In an exemplary embodiment of the present inventive concept, when the (N−1)-th line data is a low level, the N-th line data is a high level, and the (N−1)-th line pixel data does not reach a target low level of the target level, the (N−1)-th line substitution data is close to the target low level.

In an exemplary embodiment of the present inventive concept, when the (N−1)-th line data is a low level, the N-th line data is the low level, and the (N−1)-th line pixel data does not reach a target low level of the target level, the (N−1)-th line substitution data is close to the target low level.

In an exemplary embodiment of the present inventive concept, when the (N−1)-th line data is a high level, the N-th line data is the high level, and the (N−1)-th line pixel data does not reach a target high level of the target level, the (N−1)-th line substitution data is close to the target high level.

In an exemplary embodiment of the present inventive concept, the display panel includes a blue pixel, a green pixel and a red pixel. The blue pixel is repeatedly disposed in a first direction in which the gate line extends. The green pixel is repeatedly disposed in the first direction. The red pixel is repeatedly disposed in the first direction. The blue pixel, the green pixel and the red pixel are sequentially disposed in a second direction in which the data line extends.

According to an exemplary embodiment of the present inventive concept, a method of driving a display panel includes performing a line delay on N-th line data to generate (N−1)-th line data. The method of driving a display panel further includes outputting (N−1)-th line substitution data which is obtained by delaying N-th line substitution data. The N-th line substitution data is based on the N-th line data and the (N−1)-th line data. The method of driving a display panel additionally includes compensating the N-th line data based on the N-th line data and the (N−1)-th line substitution data to generate compensation image data. The method of driving a display panel further includes outputting a data signal in response to the compensation image data to a data line of a display panel. The method of driving a display panel additionally includes outputting a gate signal to a gate line of the display panel.

According to an exemplary embodiment of the present inventive concept, a display apparatus includes a display panel configured to display an image, the display panel including a gate line and a data line. The display apparatus further includes a display panel driving apparatus. The display panel driving apparatus includes a data processor configured to receive N-th line data of image data. N is a natural number not less than 2. The data processor is further configured to perform a first line delay on the N-th line data to output (N−1)-th line data, to output (N−1)-th line substitution data which is obtained by N-th line substitution data, which is based on the N-th line data and the (N−1)-th line data, and to compensate the N-th line data based on the N-th line data and the (N−1)-th line substitution data to output compensation image data. The display panel driving apparatus further includes a data driver configured to generate a data signal in response to the compensation image data output from the data processor, and to output the data signal to the data line of the display panel. The display panel driving apparatus additionally includes a gate driver configured to output a gate signal to the gate line of the display panel.

BRIEF DESCRIPTION OF THE DRAWINGS

The above and other features of the present inventive concept will become more apparent by describing in detail exemplary embodiments thereof, with reference to the accompanying drawings, in which.

DETAILED DESCRIPTION OF THE EMBODIMENTS

Exemplary embodiments of the present inventive concept will be described more fully hereinafter with reference to the accompanying drawings.

Figure 1:
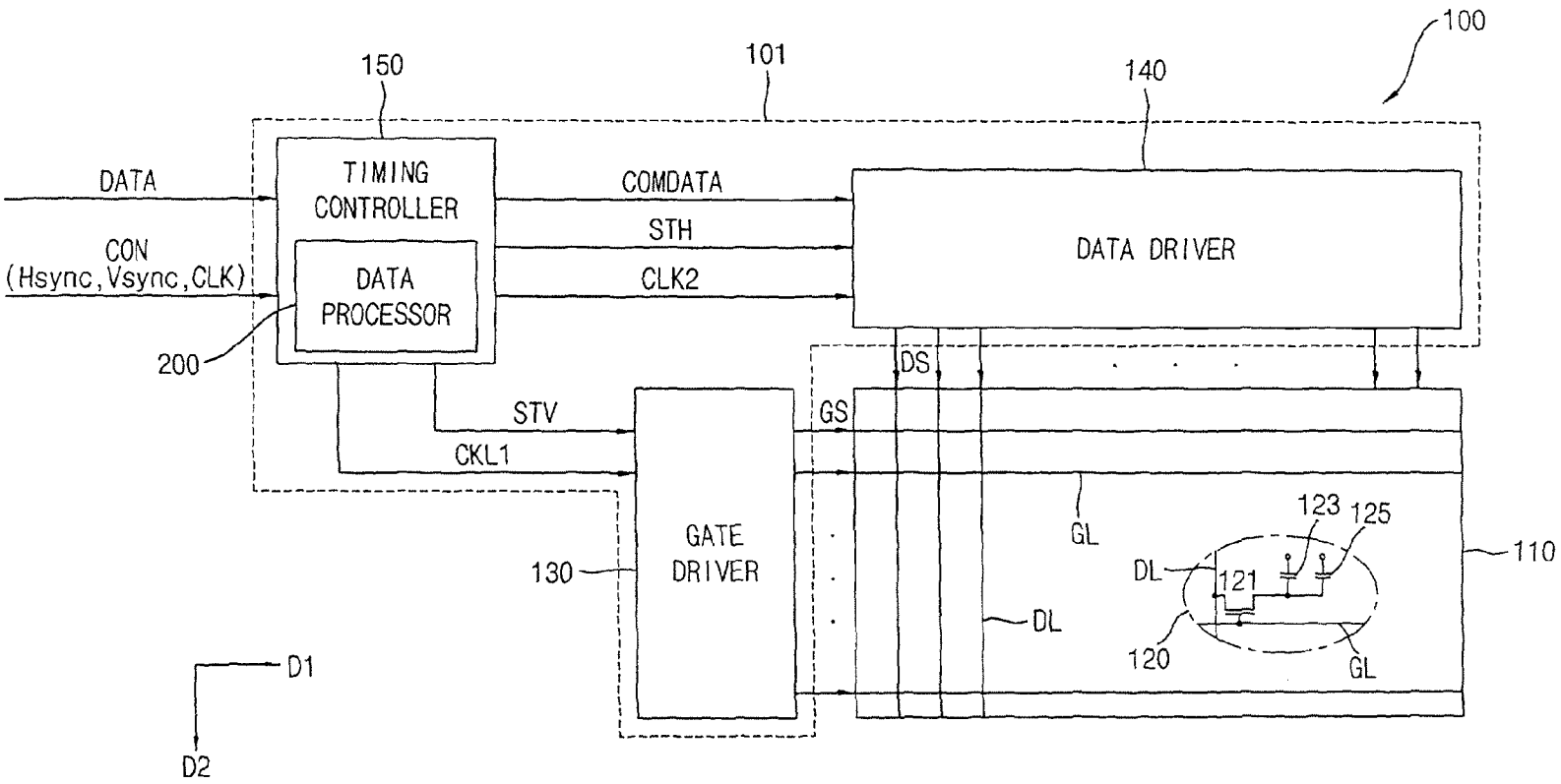
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus 100 according to an exemplary embodiment of the present inventive concept includes a display panel 110 and a display panel driving apparatus 101.

The display panel 110 receives a data signal DS based on compensation image data COMDATA provided from the timing controller 150 to display an image. The display panel 110 includes gate lines GL, data lines DL and a plurality of pixels 120. Further, the gate lines GL may extend in a first direction D1 and may be arranged in a second direction D2 which is substantially perpendicular to the first direction D1. The data lines DL may extend in the second direction D2 and may be arranged in the first direction D1. The plurality of pixels 120 may be arranged in a matrix of rows and columns. Each pixel of the plurality of pixels 120 may include a thin film transistor 121 electrically connected to one of the gate lines GL and one of the data lines DL, a liquid crystal capacitor 123 electrically connected to the thin film transistor 121, and a storage capacitor 125 electrically connected to the thin film transistor 121. For example, the gate lines GL may be electrically connected to the pixels on one column among the plurality of pixels, and the data lines DL may be electrically connected to the pixels on one row among the plurality of pixels. However, the present inventive concept is not limited thereto. Further, the display panel 110 may be, for example, a liquid crystal display panel.

The display panel driving apparatus 101 may include a gate driver 130, a data driver 140 and a timing controller 150 to drive the display panel 110.

The gate driver 130 may generate a gate signal GS in response to a vertical start signal STV and a first clock signal CLK1 sent from the timing controller 150. The gate driver 130 may output the gate signal GS to the gate line GL.

The data driver 140 may output the data signals DS to the data line DL in response to a horizontal start signal STH and a second clock signal CLK2 sent from the timing controller 150.

The timing controller 150 may receive image data DATA and a control signal CON from an external device. For example, an external device may be a device that is separate from the timing controller 150. The control signal CON may include a horizontal synchronous signal Hsync, a vertical synchronous signal Vsync and a clock signal CLK. The timing controller 150 may generate the horizontal start signal STH using the horizontal synchronous signal Hsync and outputs the horizontal start signal STH to the data driver 140. In addition, the timing controller 150 may generate the vertical start signal STV using the vertical synchronous signal Vsync and outputs the vertical start signal STV to the gate driver 130. In addition, the timing controller 150 may generate the first clock signal CLK1 and the second clock signal CLK2 using the clock signal CLK. Further, the timing controller 150 may output the first clock signal CLK1 to the gate driver 130. In addition, the timing controller 150 may output the second clock signal CLK2 to the data driver 140.

The timing controller 150 may include a data processor 200. The data processor 200 may receive the image data DATA and output the compensation image data COMDATA.

Figure 2:
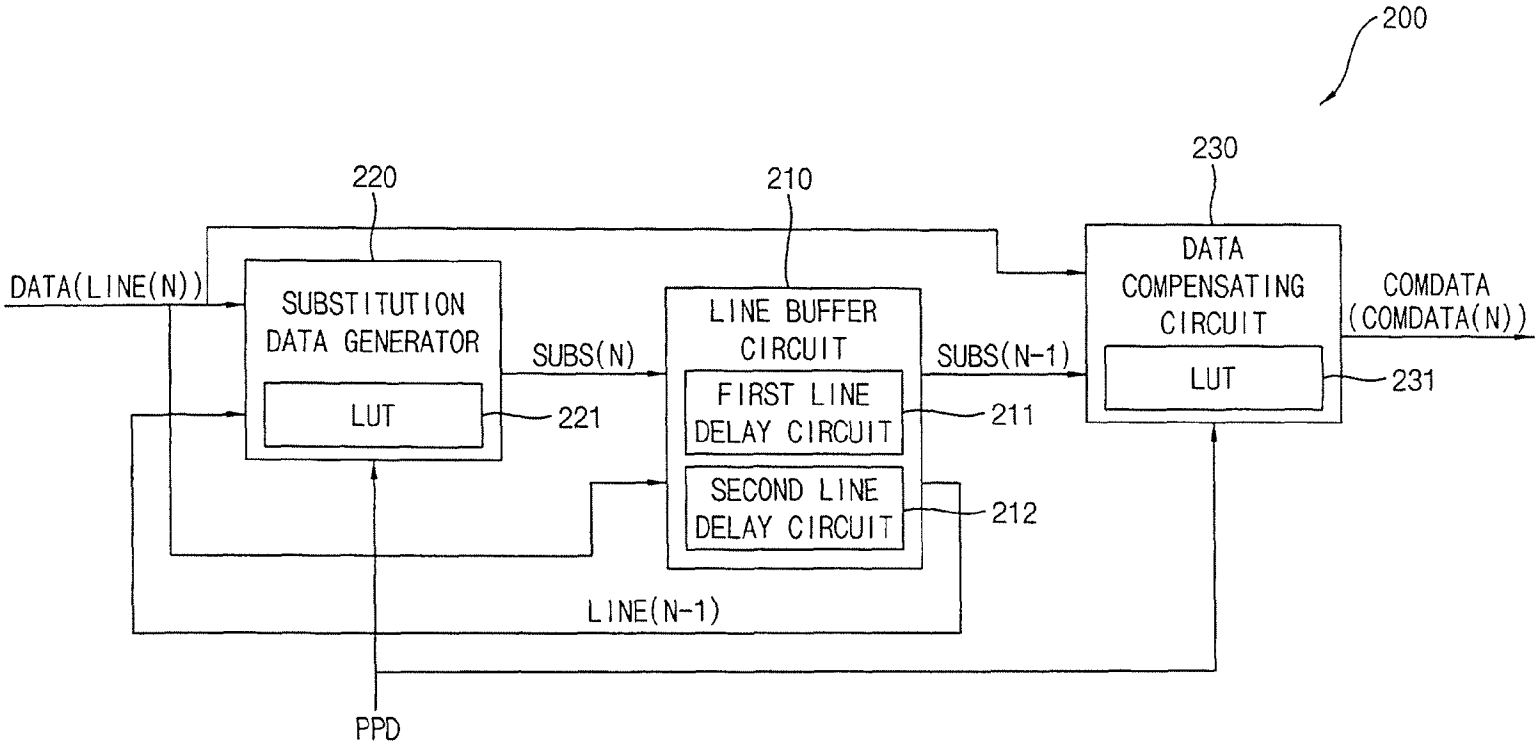
FIG. 2 is a block diagram illustrating a data processor of FIG. 1 according to an exemplary embodiment of the present inventive concept.

FIG. 2 is a block diagram illustrating the data processor 200 of FIG. 1 according to an exemplary embodiment of the present inventive concept.

Referring to FIGS. 1 and 2, the data processor 200 includes a line buffer circuit 210, a substitution data generator 220 and a data compensating circuit 230. The line buffer circuit 210 includes a first line delaying circuit 211 and a second line delaying circuit 212.

The line buffer circuit 210 may receive the line data LINE(N) of the image data DATA (e.g., DATA (LINE(N)). The first line delaying circuit 211 of the line buffer circuit 210 receives N-th (e.g., N is a natural number not less than 2) line data LINE(N) of the image data DATA. The N-th line data LINE(N) may be data corresponding to a pixel of an N-th row of the pixels 120 in the display panel 110. The first line delaying circuit 211 performs a first line delay on the N-th line data LINE(N) to output (N−1)-th line data LINE (N−1). The (N−1)-th line data LINE(N−1) may be data corresponding to a pixel of an (N−1)-th row of the pixels 120 in the display panel 110. The first line delaying circuit 211 outputs the (N−1)-th line data LINE(N−1) to the substitution data generator 220.

The substitution data generator 220 receives the N-th line data LINE(N), which may be sent from an external device, and the (N−1)-th line data LINE(N−1), which is sent from the line buffer circuit 210. The substitution data generator 220 outputs N-th line substitution data SUBS(N) using the N-th line data LINE(N) and the (N−1)-th line data LINE (N−1)). The N-th line substitution data SUBS(N) may include data enabling pixel data, which is generated by charging a pixel 120 with the compensation image data COMDATA so that the pixel 120 reaches a target level. The substitution data generator 220 may perform an over-driving on the N-th line data LINE(N) based on the N-th line data LINE(N) and the (N−1)-th line data LINE(N−1) to output the N-th line substitution data SUBS(N). Since the over-driving over-shoots a source signal which is the data signal DS, the over-driving may be referred to as a source emphasis.

The substitution data generator 220 may include a first look-up table 221. The first look-up table 221 may store and output a grayscale value of the N-th line substitution data SUBS(N) according to the received N-th line data LINE(N) and the (N−1)-th line data LINE(N−1).

The substitution data generator 220 may output the N-th line substitution data SUBS(N) based on a load of the data line DL. The load of the data line DL increases in the second direction D2 as the distance from the data driver 140 increases. Thus, the substitution data generator 220 may receive pixel position data PPD indicating a position of the pixel 120 along, the second direction D2. In addition, the substitution data generator 220 may output the N-th line substitution data SUBS(N) based on the load of the data line DL. The load of the data line D2 based on the pixel position data PPD. The pixel position data PPD may be generated based on the first clock signal CLK1 related to a driving timing of the gate driver 130. For example, the timing controller 150 may count an activation number of the first clock signal CLK1 to detect the position of the pixel 120 corresponding to the N-th line data LINE(N), and the timing controller 150 may output and determine the pixel position data PPD by detecting the position of the pixel 120. The substitution data generator 220 may include a plurality of first look-up tables that store and output different N-th line substitution data SUBS(N) according to the positions of the pixels 120. The N-th line substitution data SUBS(N) may increase according to the increase of the load of the data line DL.

The second line delaying circuit 212 of the line buffer circuit 210 may receive the N-th line substitution data SUBS(N). The second line delaying circuit 212 may perform a second line delay on the N-th line substitution data SUBS(N) to output (N−1)-th line substitution data SUBS (N−1). The (N−1)-th line substitution data SUBS(N−1) may be data generated by substituting the (N−1)-th line data LINE(N−1). In other words, the delayed N-th line substitution data SUBS(N) is output as the (N−1)-th line substitution data SUBS(N−1). The second line delaying circuit 212 may output the (N−1)-th line substitution data SUBS(N−1) to the data compensating circuit 230.

The data compensating circuit 230 may receive the N-th line data LINE(N). The data compensating circuit 230 may receive the (N−1)-th line substitution data SUBS(N−1) from the line buffer circuit 210. The data compensating circuit 230 outputs the compensation image data COMDATA using the received N-th line data LINE(N) and the received (N−1)-th line substitution data SUBS(N−1). The data compensating circuit 230 may perform the over-driving on the N-th line data LINE(N) based on the N-th line data LINE(N) and the (N−1)-th line substitution data SUBS(N−1) to output N-th line compensation image data COMDATA(N) of the compensation image data COMDATA.

The data compensating circuit 230 may include a second look-up table 231. The second look-up table 231 may store and output a grayscale value of the compensation image data COMDATA according to the N-th line data LINE(N) and the (N−1)-th line substitution data SUBS(N−1).

The data compensating circuit 230 may output the compensation image data COMDATA based on the load of the data line DL. Thus, the data compensating circuit 230 may receive the pixel position data PPD, and the data compensating circuit 230 may output the compensation image data COMDATA based on the load of the data line DL. The load of the data line DL is based on the pixel position data PPD. The data compensating circuit 230 may include a plurality of the second look-up tables 231 for storing and outputting different compensation image data COMDATA according to the positions of the pixels 120. The compensation image data COMDATA may increase according to the increase of the load of the data line DL.

Figure 3:
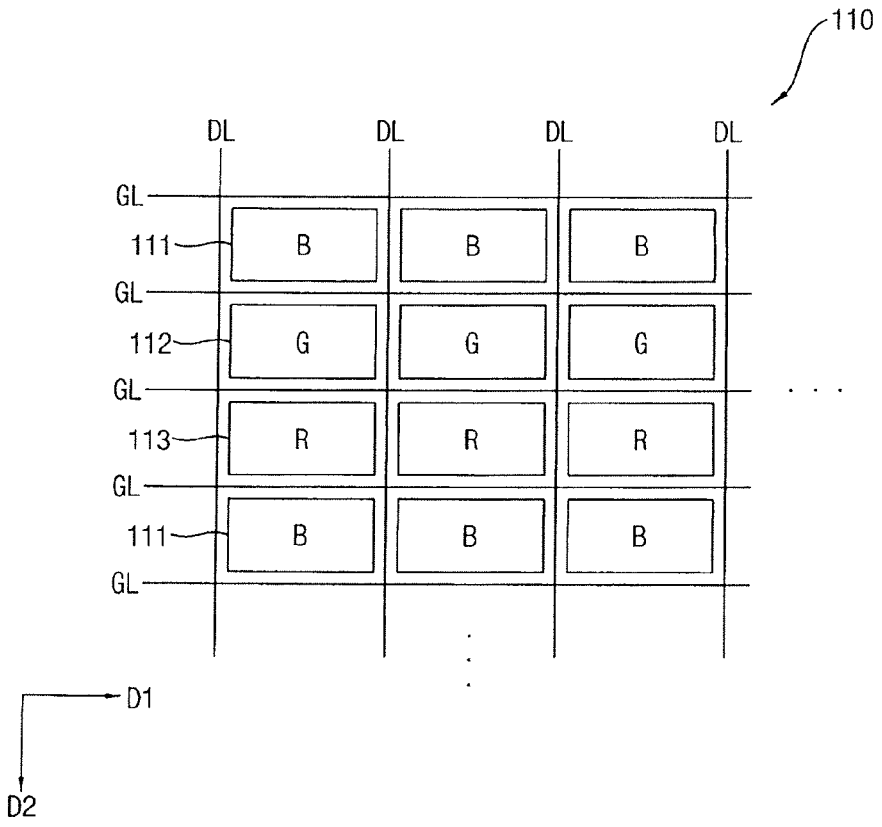
FIG. 3 is a plan view illustrating a display panel of FIG. 1 according to an exemplary embodiment of the present inventive concept.

FIG. 3 is a plan view illustrating the display panel 110 of FIG. 1 according to an exemplary embodiment of the present inventive concept.

Referring to FIGS. 1 to 3, the display panel 110 may include a blue pixel 111, a green pixel 112 and a red pixel 113. The blue pixel 111 may be repeatedly disposed in the first direction D1 in the display panel 110. Further, the blue pixel 111 may be disposed between the red pixel 113 and the green pixel 112 in the second direction D2. The green pixel 112 may be repeatedly disposed in the first direction D1 in the display panel 110. The green pixel 112 may be disposed between the blue pixel 111 and the red pixel 113 in the second direction D2. The red pixel 113 may be repeatedly disposed in the first direction D1 in the display panel 110. The red pixel 113 may be disposed between the green pixel 112 and the blue pixel 111 in the second direction D2. For example, a possible arrangement of the pixels 111, 112 and 113 on the display panel 110 in the second direction D2 may be in the following order: red pixel 113, blue pixel 111, green pixel 112, red pixel 113, blue pixel 111 and green pixel 112.

For example, when the red pixel 113 is an N-th line pixel, the green pixel 112 may be an (N−1)-th line pixel and the blue pixel 111 may be an (N−2)-th line pixel. As an additional example, when the green pixel 112 is the N-th line pixel, the blue pixel 111 may be the (N−1)-th line pixel and the red pixel 113 may be the (N−2)-th line pixel. As a further example, when the blue pixel 111 is the N-th line pixel, the red pixel 113 may be the (N−1)-th line pixel and the green pixel 112 may be the (N−2)-th line pixel.

Figure 4A:
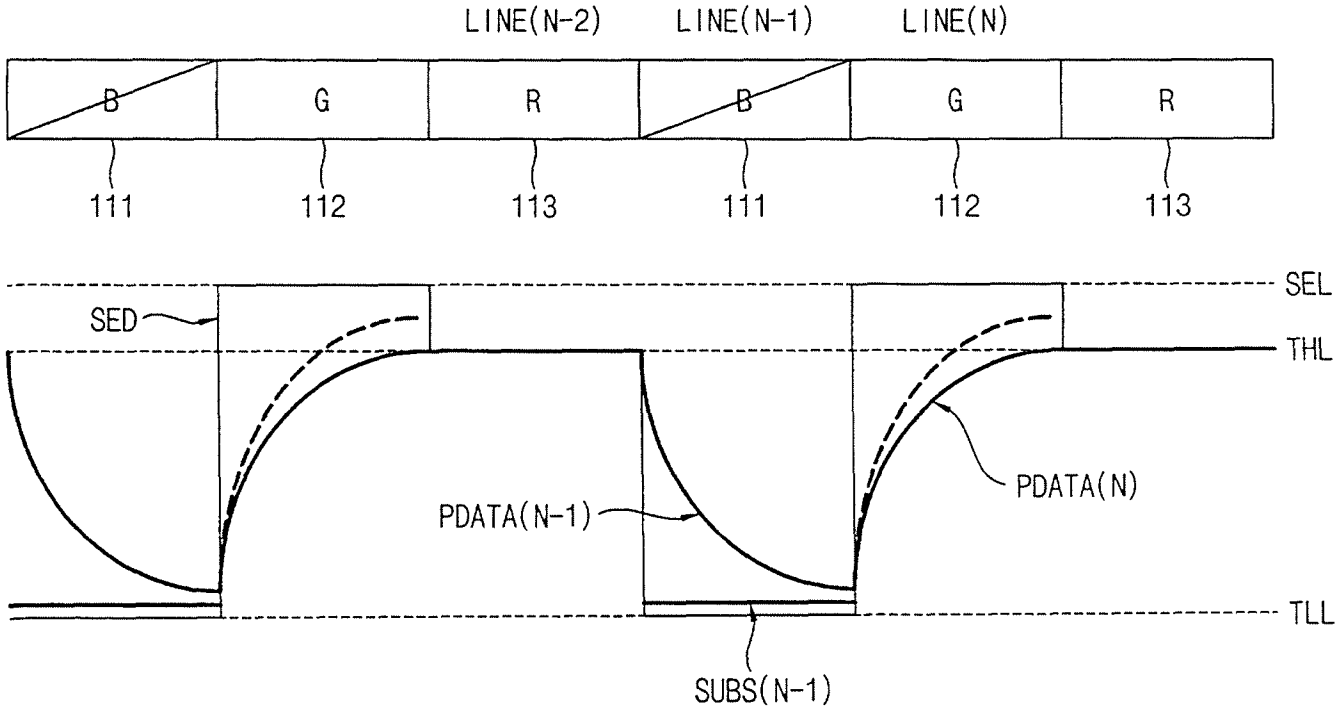
FIGS. 4A, 4B and 4C are waveform diagrams illustrating pixel data of compensation image data of FIGS. 1 and 2 according to an exemplary embodiment of the present inventive concept.
Figure 4B:
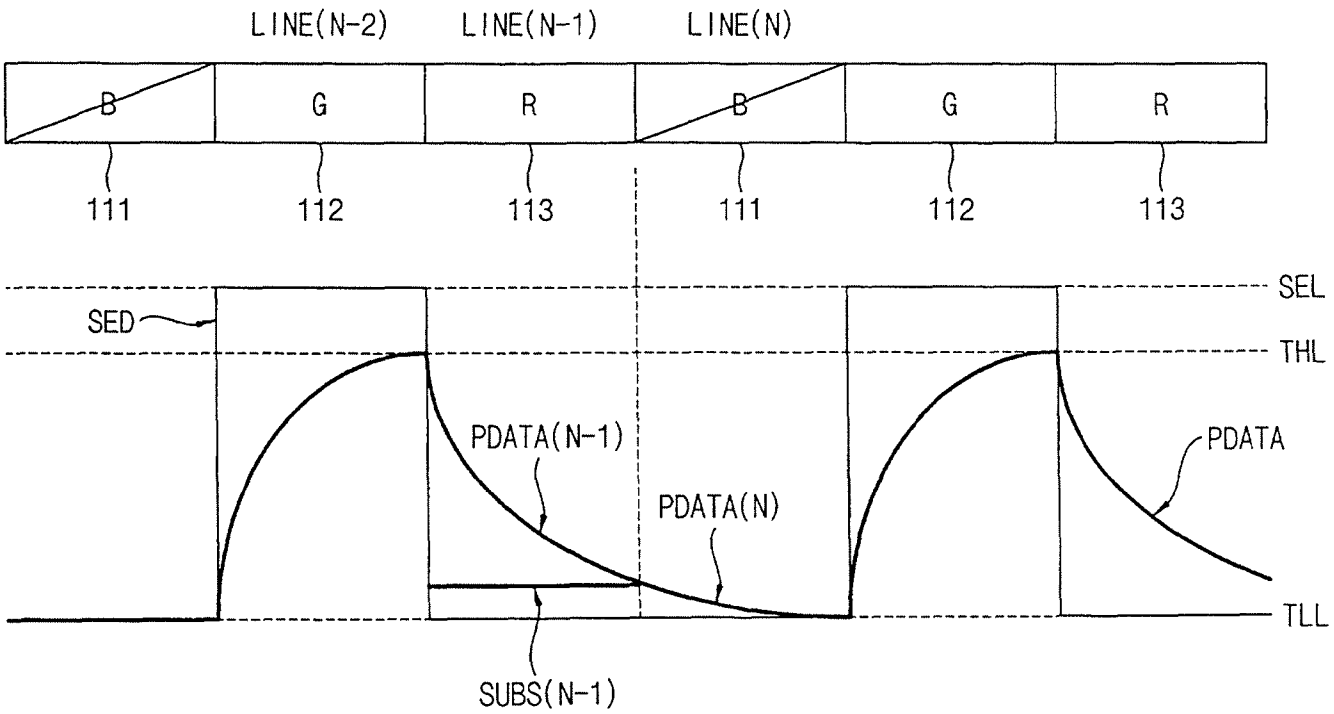
Figure 4C:
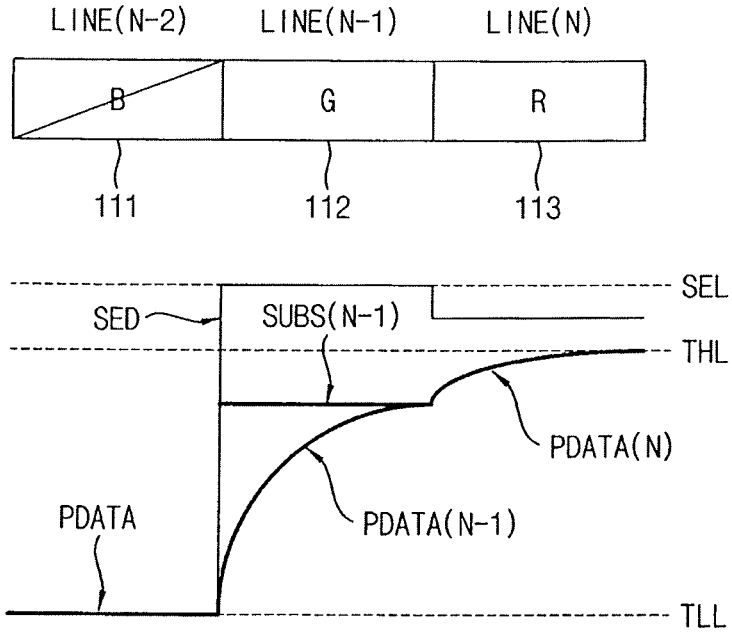

FIGS. 4A to 4C are waveform diagrams illustrating pixel data PDATA of the compensation image data COMDATA of FIGS. 1 and 2 according to an exemplary embodiment of the present inventive concept.

Referring to FIGS. 1 to 4A, the N-th line data LINE(N) may correspond to the green pixel 112, the (N−1)-th line data LINE(N−1) may correspond to the blue pixel 111, and the (N−2)-th line data LINE(N−2) may correspond to the red pixel 113. The display panel driving apparatus 101 may deactivate the blue pixel 111, may activate the green pixel 112, and may activate the red pixel 113. Thus, the (N−2)-th line data LINE(N−2) may be a high level (e.g., a pixel activation level), the (N−1)-th line data LINE(N−1) may be a low level (e.g., a pixel deactivation level), and the N-th line data LINE(N) may be a high level. In this case, (N−1)-th line pixel data PDATA(N−1), which is generated by charging the (N−1)-th line data LINE(N−1) to the (N−1)-th line pixel, might not reach a target low level TLL (e.g., corresponding to pixel off). Therefore, when the data processor 200 performs the over-driving on the N-th line data LINE(N) based on the (N−1)-th pixel data PDATA(N−1), N-th line pixel data PDATA(N), which is generated by charging the N-th line compensation image data COMDATA(N) to the N-th line pixel, may be greater than a target high level THL (e.g., corresponding to pixel on) of the target level. Thus, the compensation image data COMDATA may be over-compensated.

Therefore, when the (N−1)-th line pixel data PDATA(N−1) does not reach the target low level TLL, the data processor 200 outputs the (N−1)-th line substitution data SUBS (N−1). The (N−1)-th line substitution data SUB(N−1) may be close to the target low level TLL or may correspond to the target low level TLL.

The data compensating circuit 230 of the data processor 200 performs the over-driving on the N-th line data LINE(N) based on the N-th line data LINE(N) and the (N−1)-th line substitution data SUBS(N−1) to output the N-th line compensation image data COMDATA(N). Thus, the N-th line pixel data PDATA(N), which is generated by charging the N-th line compensation image data COMDATA(N) to the N-th line pixel, might not be greater than the target high level THL. However, the N-th line pixel data PDATA(N) may properly reach the target high level THL. The data compensating circuit 230 may output the compensation image data COMDATA with reference to a source emphasis level SEL of source emphasis data SED. The source emphasis data SED may be the grayscale value of the compensation image data COMDATA according to the N-th line data LINE(N) and the (N−1)-th line substitution data SUBS(N−1) stored in the second look-up table 231.

Referring to FIGS. 1 to 3 and 4B, the N-th line data LINE(N) may correspond to the blue pixel 111, the (N−1)-th line data LINE(N−1) may correspond to the red pixel 113, and the (N−2)-th line data LINE(N−2) may correspond to the green pixel 112. The display panel driving apparatus 101 may activate the green pixel 112, may deactivate the red pixel 113, and may deactivate the blue pixel 111. Thus, the (N−2)-th line data LINE(N−2) may be a high level (e.g., an activation level), the (N−1)-th line data LINE(N−1) may be a low level, and the N-th line data LINE(N) may be a low level (e.g., a deactivation level). For example, the N-th line data LINE(N) may be a level lower than the level of the (N−1)-th line data LINE(N−1). In this case, the (N−1)-th line pixel data PDATA(N−1) generated by charging the (N−1)-th line data LINE(N−1) to the (N−1)-th line pixel might not reach the target low level TLL. In this case, when the data processor 200 performs the over-driving on the N-th line data LINE(N) based on the (N−1)-th pixel data PDATA(N−1), the N-th line pixel data PDATA(N), which is generated by charging the N-th line compensation image data COMDATA(N) to the N-th line pixel, might not reach the target low level TLL.

Therefore, when the (N−1)-th line pixel data PDATA(N−1) does not reach the target low level TLL, the data processor 200 generates the (N−1)-th line substitution data SUBS (N−1). The (N−1)-th line substitution data SUB(N−1) may be close to the target low level TLL or may correspond to the target low level TLL.

The data compensating circuit 230 of the data processor 200 performs the over-driving on the N-th line data LINE(N) based on the N-th line data LINE(N) and the (N−1)-th line substitution data SUBS(N−1) to output the N-th line compensation image data COMDATA(N). Thus, the N-th line pixel data PDATA(N), which is generated by charging the N-th line compensation image data COMDATA(N) to the N-th line pixel, may properly reach the target low level TLL.

Referring to FIGS. 1 to 3 and 4C, the N-th line data LINE(N) may correspond to the red pixel 113, the (N−1)-th line data LINE(N−1) may correspond to the green pixel 112, and the (N−2)-th line data LINE(N−2) may correspond to the blue pixel 111. The display panel driving apparatus 101 may deactivate the blue pixel 111, may activate the green pixel 112, and may activate the red pixel 113. Thus, the (N−2)-th line data LINE(N−2) may be a low level, the (N−1)-th line data LINE(N−1) may be a high level, and the N-th line data LINE(N) may be a high level. For example, the (N−1)-th line data LINE(N−1) and N-th line data LINE (N) may be close to the target high level THL. In this case, the (N−1)-th line pixel data PDATA(N−1), which is generated by charging the (N−1)-th line data LINE(N−1) to the (N−1)-th line pixel, might not reach the target high level THL of the target level. In this case, when the data processor 200 performs the over-driving on the N-th line data LINE(N) based on the (N−1)-th pixel data PDATA(N−1), the N-th line pixel data PDATA(N), which is generated by charging the N-th line compensation image data COMDATA(N) to the N-th line pixel, might not reach the target high level THL.

Therefore, when the (N−1)-th line pixel data PDATA(N−1) does not reach the target high level THL, the data processor 200 generates the (N−1)-th line substitution data SUBS(N−1). The (N−1)-th line substitution data SUB(N−1) may be close to the target high level THL or may correspond to the target high level THL.

The data compensating circuit 230 of the data processor 200 performs the over-driving on the N-th line data LINE(N) based on the N-th line data LINE(N) and the (N−1)-th line substitution data SUBS(N−1) to generate the N-th line compensation image data COMDATA(N). Thus, the N-th line pixel data PDATA(N) generated by charging the N-th line compensation image data COMDATA(N) to the N-th line pixel may properly reach the target high level THL.

Figure 5:
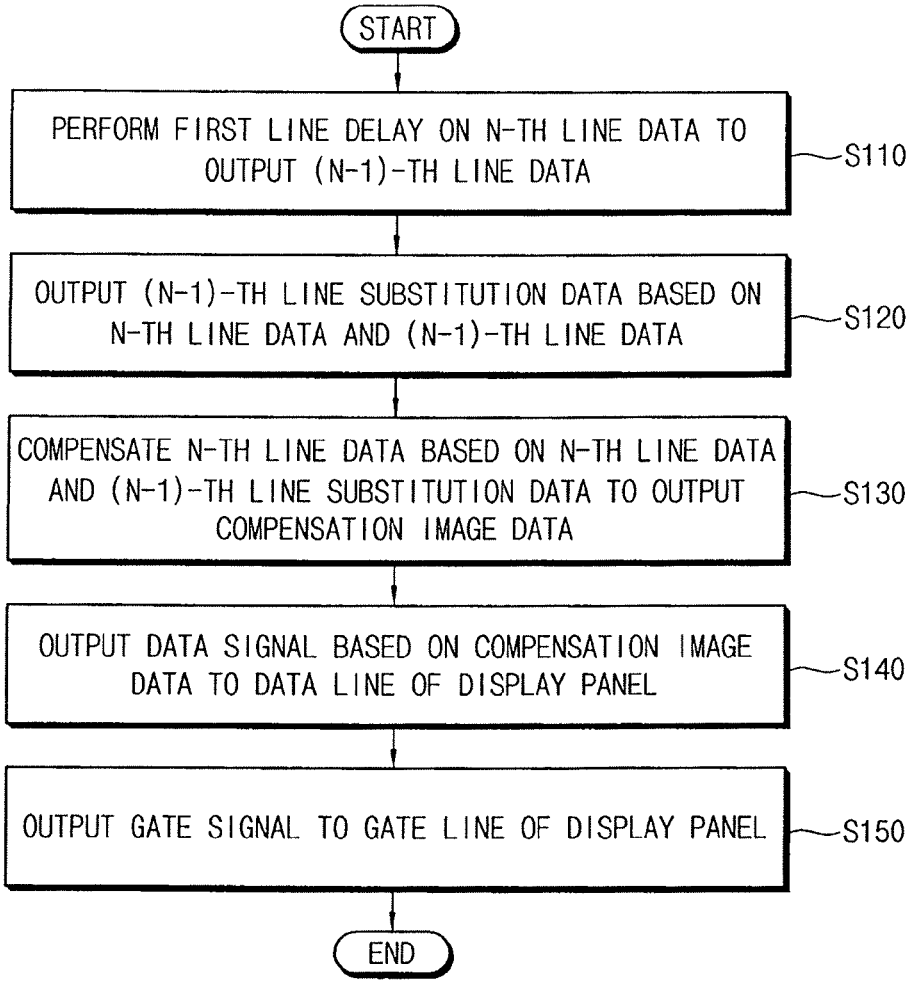
FIG. 5 is a flow chart illustrating a method of driving a display panel using a display panel driving apparatus of FIG. 1 according to an exemplary embodiment of the present inventive concept.

FIG. 5 is a flow chart illustrating a method of driving a display panel using the display panel driving apparatus 101 of FIG. 1 according to an exemplary embodiment of the present inventive concept.

Referring to FIGS. 1 to 5, the first line delay may be performed on the N-th line data LINE(N) to output the (N−1)-th line data LINE(N−1) (step S110). For example, the first line delaying circuit 211 of the line buffer circuit 210 may receive the N-th line data LINE(N) of the image data DATA. The N-th line data LINE(N) may be the data corresponding to the pixel of the N-th row in the display panel 110. The first line delaying circuit 211 performs the first line delay on the N-th line data LINE(N) to output the (N−1)-th line data LINE(N−1). The (N−1)-th line data LINE(N−1) may be the data corresponding to the pixel of the (N−1)-th row in the display panel 110. The first line delaying circuit 211 outputs the (N−1)-th line data LINE(N−1) to the substitution data generator 220.

The (N−1)-th line substitution data SUB(N−1) may be generated based on the N-th line data LINE(N) and the (N−1)-th line data LINE(N−1)) (step S120). For example, the substitution data generator 220 may receive the N-th line data LINE(N) and the (N−1)-th line data LINE(N−1). The substitution data generator 220 may output the N-th line substitution data SUBS(N) based on the N-th line data LINE(N) and the (N−1)-th line data LINE(N−1)). The N-th line substitution data SUBS(N) may be the data enabling the pixel data generated by charging the compensation image data COMDATA to the pixel 120 to reach the target level. The substitution data generator 220 may perform the over-driving on the N-th line data LINE(N) based on the N-th line data LINE(N) and the (N−1)-th line data LINE(N−1) to generate the N-th line substitution data SUBS(N). Since the over-driving over-shoots the source signal which is the data signal DS, the over-driving may be referred to as the source emphasis.

The substitution data generator 220 may include the first look-up table 221. The first look-up table 221 may store and output the grayscale value of the N-th line substitution data SUBS(N) according to the N-th line data LINE(N) and the (N−1)-th line data LINE(N−1).

The substitution data generator 220 may output the N-th line substitution data SUBS(N) based on the load of the data line DL. The load of the data line DL may increase in the second direction D2 as the distance from the data driver 140 increases. Thus, the substitution data generator 220 may receive the pixel position data PPD indicating the position of the pixel 120 along the second direction D2, and the substitution data generator 220 may output the N-th line substitution data SUBS(N) based on the load of the data line DL, which is based on the pixel position data PPD. The pixel position data PPD may be generated based on the first clock signal CLK1 corresponding to the timing of the driving of the gate driver 130. For example, the timing controller 150 may count the activation number of the first clock signal CLK1 to detect the position of the pixel 120 corresponding to the N-th line data LINE(N). Thus, the timing controller 150 may output the pixel position data PPD by determining the position of the pixel 120. The substitution data generator 220 may include the first look-up tables storing and outputting different N-th line substitution data SUBS(N) according to the positions of the pixels 120. The N-th line substitution data SUBS(N) may increase according to the increase of the load of the data line DL.

The second line delaying circuit 212 of the line buffer circuit 210 may receive the N-th line substitution data SUBS(N). The second line delaying circuit 212 may perform the second line delay on the N-th line substitution data SUBS(N) to output the (N−1)-th line substitution data SUBS(N−1). The (N−1)-th line substitution data SUBS(N−1) may be generated by substituting the (N−1)-th line data LINE(N−1). The second line delaying circuit 212 may output the (N−1)-th line substitution data SUBS(N−1) to the data compensating circuit 230.

The N-th line data LINE(N) is compensated based on the N-th line data LINE(N) and the (N−1)-th line substitution data SUBS(N−1) to output the compensation image data COMDATA (step S130). For example, the data compensating circuit 230 may receive the N-th line data LINE(N) and the (N−1)-th line substitution data SUBS(N−1). The data compensating circuit 230 may output the compensation image data COMDATA using the N-th line data LINE(N) and the (N−1)-th line substitution data SUBS(N−1). The data compensating circuit 230 may perform the over-driving on the N-th line data LINE(N) based on the N-th line data LINE(N) and the (N−1)-th line substitution data SUBS(N−1) to output the N-th line compensation image data COMDATA(N).

The data compensating circuit 230 may include the second look-up table 231. The second look-up table 231 may store and output the grayscale value of the compensation image data COMDATA according to the N-th line data LINE(N) and the (N−1)-th line substitution data SUBS(N−1).

The data compensating circuit 230 may output the compensation image data COMDATA based on the load of the data line DL. Thus, the data compensating circuit 230 may receive the pixel position data PPD, and the data compensating circuit 230 may output the compensation image data COMDATA based on the load of the data line DL which is based on the pixel position data PPD. The data compensating circuit 230 may include the second look-up tables 231 storing and outputting different compensation image data COMDATA according to the positions of the pixels 120. The compensation image data COMDATA may increase according to the increase of the load of the data line DL.

The data signal DS based on the compensation image data COMDATA may be output to the data line DL of the display panel 110 (step S140). For example, the data driving circuit 140 may receive the compensation image data COMDATA from the timing controller 150. The data driver 140 generates the data signal DS based on the compensation image data COMDATA. The data driver 140 outputs the data signals DS to the data line DL in response to the horizontal start signal STH and the second clock signal CLK2 provided from the timing controller 150.

The gate signal GS is output to the gate line GL of the display panel 110 (step S150). For example, the gate driver 130 generates the gate signal GS in response to the vertical start signal STV and the first clock signal CLK1 provided from the timing controller 150. The gate driver 130 outputs the gate signal GS to the gate line GL.

According to an exemplary embodiment of the present inventive concept, when the (N−1)-th line pixel data PDATA (N−1) does not reach the target level, the data processor 200 generates the (N−1)-th line substitution data SUBS(N−1). In addition, the data processor 200 performs the over-driving on the N-th line data LINE(N) using the N-th line data LINE(N) and the (N−1)-th line substitution data SUBS(N−1) to output the compensation image data COMDATA. Therefore, the N-th line pixel data PDATA(N) may properly reach the target level. Thus, display quality of the display apparatus 100 may be increased.

In a display panel driving apparatus, a method of driving a display panel using the display panel driving apparatus and a display apparatus having the display panel driving apparatus, according to an exemplary embodiment of the present inventive concept, when an (N−1)-th line pixel data does not reach a target level, a data processor generates (N−1)-th line substitution data, and performs an over-driving on the N-th line data using the N-th line data and the (N−1)-th line substitution data to output compensation image data. Therefore, N-th line pixel data generated by charging the N-th line data to a pixel may properly reach the target level. Thus, display quality of the display apparatus may be increased.

Exemplary embodiments of the present inventive concept are described, and illustrated in the drawings, in terms of functional blocks, units, part and/or modules. Those skilled in the art will appreciate that these blocks, units, part and/or modules are physically implemented by electronic (or optical) circuits such as logic circuits, discrete components, microprocessors, hard-wired circuits, memory elements, wiring connections, and the like, which may be formed using semiconductor-based fabrication techniques or other manufacturing technologies. In the case of the blocks, units, part and/or modules being implemented by microprocessors or similar, they may be programmed using software (e.g., microcode) to perform various functions discussed herein and may optionally be driven by firmware and/or software. Alternatively, each block, unit, part and/or module may be implemented by dedicated hardware, or as a combination of dedicated hardware to perform some functions and a processor (e.g., one or more programmed microprocessors and associated circuitry) to perform other functions. Also, each block, unit, part and/or module of the exemplary embodiments may be physically separated into two or more interacting and discrete blocks, units, part and/or modules without departing from the scope of the inventive concepts.

While the present inventive concept has been particularly shown and described with reference to exemplary embodiments thereof, it will be apparent to those of ordinary skill in the art that various changes in form and detail may be made thereto without departing from the spirit and scope of the present inventive concept as defined by the following claims.

What is claimed is:

1. A display panel driving apparatus comprising:

a data processor configured to receive N-th line data of image data, wherein N is a natural number not less than 2, to perform a first line delay on the N-th line data to output (N−1)-th line data, to output (N−1)-th line substitution data which is obtained by N-th line substitution data, which is based on the N-th line data and the (N−1)-th line data, and to compensate the N-th line data based on the N-th line data and the (N−1)-th line substitution data to output compensation image data;

a data driver configured to generate a data signal in response to the compensation image data output from the data processor, and to output the data signal to a data line of a display panel; and a gate driver configured to output a gate signal to a gate line of the display panel.

2. The display panel driving apparatus of claim 1, wherein the data processor comprises:

a first line delaying circuit configured to receive the N-th line data, and to perform the first line delay on the N-th line data to output the (N−1)-th line data;

a substitution data generator configured to generate the N-th line substitution data based on the N-th line data and the (N−1)-th line data; and a second line delaying circuit configured to perform a second line delay on the N-th line substitution data and to output the (N−1)-th line substitution data.

3. The display panel driving apparatus of claim 2, wherein the substitution data generator comprises a first look-up table for storing the N-th line substitution data according to the N-th line data and the (N−1)-th line data.

4. The display panel driving apparatus of claim 2, wherein the substitution data generator receives pixel position data indicating a pixel position in the display panel, and wherein the N-th line substitution data is different according to the pixel position.

5. The display panel driving apparatus of claim 4, wherein the substitution data generator comprises a plurality of first look-up tables for storing the N-th line substitution data.

6. The display panel driving apparatus of claim 4, wherein a load of the data line increases along a direction in which the data line extends away from the data driver, and the pixel position data indicates the pixel position along the direction in which the data line extends.

7. The display panel driving apparatus of claim 2, wherein the data processor further comprises a data compensating circuit configured to compensate the N-th line data based on the N-th line data and the (N−1)-th line substitution data and to output the compensation image data.

8. The display panel driving apparatus of claim 7, wherein the data compensating circuit comprises a second look-up table for storing the compensation image data according to the N-th line data and the (N−1)-th line substitution data.

9. The display panel driving apparatus of claim 7, wherein the data compensating circuit receives pixel position data indicating a pixel position in the display panel, and wherein the compensation image data is different according to the pixel position.

10. The display panel driving apparatus of claim 9, wherein the data compensating circuit comprises a plurality of second look-up tables for storing the compensation image data.

11. The display panel driving apparatus of claim 9, wherein a load of the data line increases along a direction in which the data line extends away from the data driver, and the pixel position data indicates the pixel position of a pixel along the direction in which the data line extends.

12. The display panel driving apparatus of claim 11, wherein the compensation image data increases according to an increase of the load of the data line.

13. The display panel driving apparatus of claim 1, wherein, when (N−1)-th line pixel data, which is generated by charging the compensation image data to an (N−1)-th line pixel, does not reach a target level, the data processor outputs the (N−1)-th line substitution data.

14. The display panel driving apparatus of claim 13, wherein the (N−1)-th line substitution data is close to the target level.

15. The display panel driving apparatus of claim 13, wherein, when the (N−1)-th line data is a low level, the N-th line data is a high level, and the (N−1)-th line pixel data does not reach a target low level of the target level, the (N−1)-th line substitution data is close to the target low level.

16. The display panel driving apparatus of claim 13, wherein, when the (N−1)-th line data is a low level, the N-th line data is the low level, and the (N−1)-th line pixel data does not reach a target low level of the target level, the (N−1)-th line substitution data is close to the target low level.

17. The display panel driving apparatus of claim 13, wherein, when the (N−1)-th line data is a high level, the N-th line data is the high level, and the (N−1)-th line pixel data does not reach a target high level of the target level, the (N−1)-th line substitution data is close to the target high level.

18. The display panel driving apparatus of claim 1, wherein the display panel comprises a blue pixel, a green pixel and a red pixel, wherein the blue pixel is repeatedly disposed in a first direction in which the gate line extends, the green pixel is repeatedly disposed in the first direction, the red pixel is repeatedly disposed in the first direction, and the blue pixel, the green pixel and the red pixel are sequentially disposed in a second direction in which the data line extends.

19. A method of driving a display panel, the method comprising:

performing a line delay on N-th line data to generate (N−1)-th line data;

outputting (N−1)-th line substitution data which is obtained by delaying N-th line substitution data, wherein the N-th line substitution data is based on the N-th line data and the (N−1)-th line data;

compensating the N-th line data based on the N-th line data and the (N−1)-th line substitution data to generate compensation image data;

outputting a data signal in response to the compensation image data to a data line of a display panel; and outputting a gate signal to a gate line of the display panel.

20. A display apparatus comprising:

a display panel configured to display an image, the display panel including a gate line and a data line; and a display panel driving apparatus comprising:

a data processor configured to receive N-th line data of image data, wherein N is a natural number not less than 2, to perform a first line delay on the N-th line data to output (N−1)-th line data, to output (N−1)-th line substitution data which is obtained by N-th line substitution data, which is based on the N-th line data and the (N−1)-th line data, and to compensate the N-th line data based on the N-th line data and the (N−1)-th line substitution data to output compensation image data;

a data driver configured to generate a data signal in response to the compensation image data output from the data processor, and to output the data signal to the data line of the display panel; and a gate driver configured to output a gate signal to the gate line of the display panel.

* * * * *